US011859354B1

(12) United States Patent
Dibb et al.

(10) Patent No.: US 11,859,354 B1
(45) Date of Patent: Jan. 2, 2024

(54) SYSTEMS AND METHODS FOR MILLING PAVING MATERIAL WITH AN ADJUSTABLE RETRACTABLE BREAKER BAR

(71) Applicant: Asphalt Zipper, Inc., Pleasant Grove, UT (US)

(72) Inventors: Nathan Douglas Dibb, Pleasant Grove, UT (US); J. Tron Haroldsen, Pleasant Grove, UT (US)

(73) Assignee: Asphalt Zipper, Inc., Pleasant Grove, UT (US)

( * ) Notice: Subject to any disclaimer, the term of this patent is extended or adjusted under 35 U.S.C. 154(b) by 0 days.

(21) Appl. No.: 17/874,129

(22) Filed: Jul. 26, 2022

(51) Int. Cl.
*E01C 23/12* (2006.01)
*E01C 23/088* (2006.01)

(52) U.S. Cl.
CPC ..... *E01C 23/088* (2013.01); *E01C 23/127* (2013.01)

(58) Field of Classification Search
CPC .... B02C 13/095; E01C 23/088; E01C 23/127
See application file for complete search history.

(56) References Cited

U.S. PATENT DOCUMENTS 2,905,456 A * 9/1959 Rafferty ..... E01C 23/127 241/294
7,144,087 B2 * 12/2006 Haroldsen ..... E01C 23/088 404/94
7,810,888 B2 * 10/2010 Clark ..... B02C 13/09 299/39.1

FOREIGN PATENT DOCUMENTS

CN 107159387 A * 9/2017

* cited by examiner

*Primary Examiner* — Janine M Kreck
(74) *Attorney, Agent, or Firm* — Dax D. Anderson; Kirton McConkie

(57) ABSTRACT

A retractable breaker bar is distanced from a cutting head by actuation of a hydraulic ram in a system for grinding material.

1 Claim, 6 Drawing Sheets

SYSTEMS AND METHODS FOR MILLING PAVING MATERIAL WITH AN ADJUSTABLE RETRACTABLE BREAKER BAR

BACKGROUND OF THE INVENTION

1. Field of the Invention

The present invention relates to systems and methods for milling paving material. More particularly, the present invention relates to systems and methods that provide the ability to control the size of the ground paving material.

2. Background and Related Art

Asphalt milling is a technique currently employed to remove asphalt pavement for reconstruction or resurfacing, and for accessing buried utility lines. The technique involves the removal of asphalt pavement through the use of a cold planer, which can remove up to approximately two inches of pavement surface during a particular pass.

A cold planer typically includes a barrel-like attachment, referred to as a mandrel, and a variety of that are affixed to the exterior surface of the mandrel. Coupled to the cold planer is a vehicle with a bucket that is used to control the speed of the cold planer. The mandrel rotates and is pushed into the pavement by the hydraulic system of the vehicle, causing the bits to grind up the asphalt pavement. The vehicle pushes the cold planer as the mandrel rotates to grind a trench in the asphalt pavement.

SUMMARY OF THE INVENTION

The present invention relates to systems and methods for milling paving material. More particularly, the present invention relates to systems and methods that provide the ability to control the size of the ground paving material.

Implementation of the present invention takes place in association with a powered milling system for use in milling or grinding asphalt and is configured for coupling to a vehicle with a bucket that selectively pushes or pulls the milling system in a desired direction. The milling system includes a cylindrical mandrel, having a variety of bits attached thereon, which spins on an axis to break up and mill the asphalt. The mandrel is powered by a milling system motor that speeds up production and enables milling of very thick asphalt in a single pass. A retractable breaker bar of the milling system is continuously located at or near ground level during the milling process to hold the asphalt down as it tries to lift up during the process. The breaker bar further assists in breaking up the milled asphalt aggregate. In some embodiments of the present invention, the breaker bar is adjustable and retractable. Extension of the breaker bar inhibits the flow of ground material thereby allowing the material to be exposed to the grinding action of the bits for a longer period of time resulting in smaller material. If larger material is desired, the breaker bar may be retracted into the hatch that covers the grinding area. Varying the extension of the breaker bar controls the size of the material left behind in the trench. An operator walking next to the vehicle and attached milling apparatus can view the size of the material left behind and then extend or retract the breaker bar to obtain the desired size of material. The operator can also extend or retract the breaker bar to control the amount of load on the engine driving the milling drum. Additionally, the operator of the vehicle propelling the milling apparatus can vary the speed of the system to allow the milling apparatus time to grind the material without unduly bogging down the engine driving the milling apparatus.

While the methods and processes of the present invention have proven to be particularly useful in providing increased stability, support and power in the area of milling asphalt, those skilled in the art shall appreciate that the methods and processes can be used to mill a variety of different surfaces.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to systems and methods for milling paving material. More particularly, the present invention relates to systems and methods that provide increased stability, support and power while grinding paving material.

In the disclosure and in the claims the term "paving material" shall refer to any material that may be used to pave a road, path, sidewalk, parking lot, driveway, thoroughfare, or any other similar surface. Examples of paving materials include asphalt, tarmac, pavement, cement, clay, stone and dirt.

Embodiments of the present invention take place in association with a self-powered milling system that may be used to mill or grind paving material, and that may be configured to be coupled to a vehicle (e.g., a bobcat, steer-skid, back hoe, excavator or other vehicle) that selectively pushes or pulls the self-powered milling system in a desired direction. The milling system includes a cutting head, such as a cylindrical mandrel that includes a variety of bits attached thereon. The mandrel spins on an axis to break up and mill the paving material, and is powered by a milling system motor that speeds up production and enables the milling of very thick paving material (e.g., 8 inch thick asphalt) in a single pass.

In one embodiment, a breaker bar is coupled to the carriage. The breaker bar is continuously located at or near ground level to hold the asphalt down as it tries to lift up during the milling process. The breaker bar is further employed to assist in the breaking up the milled asphalt aggregate.

Figure 1:
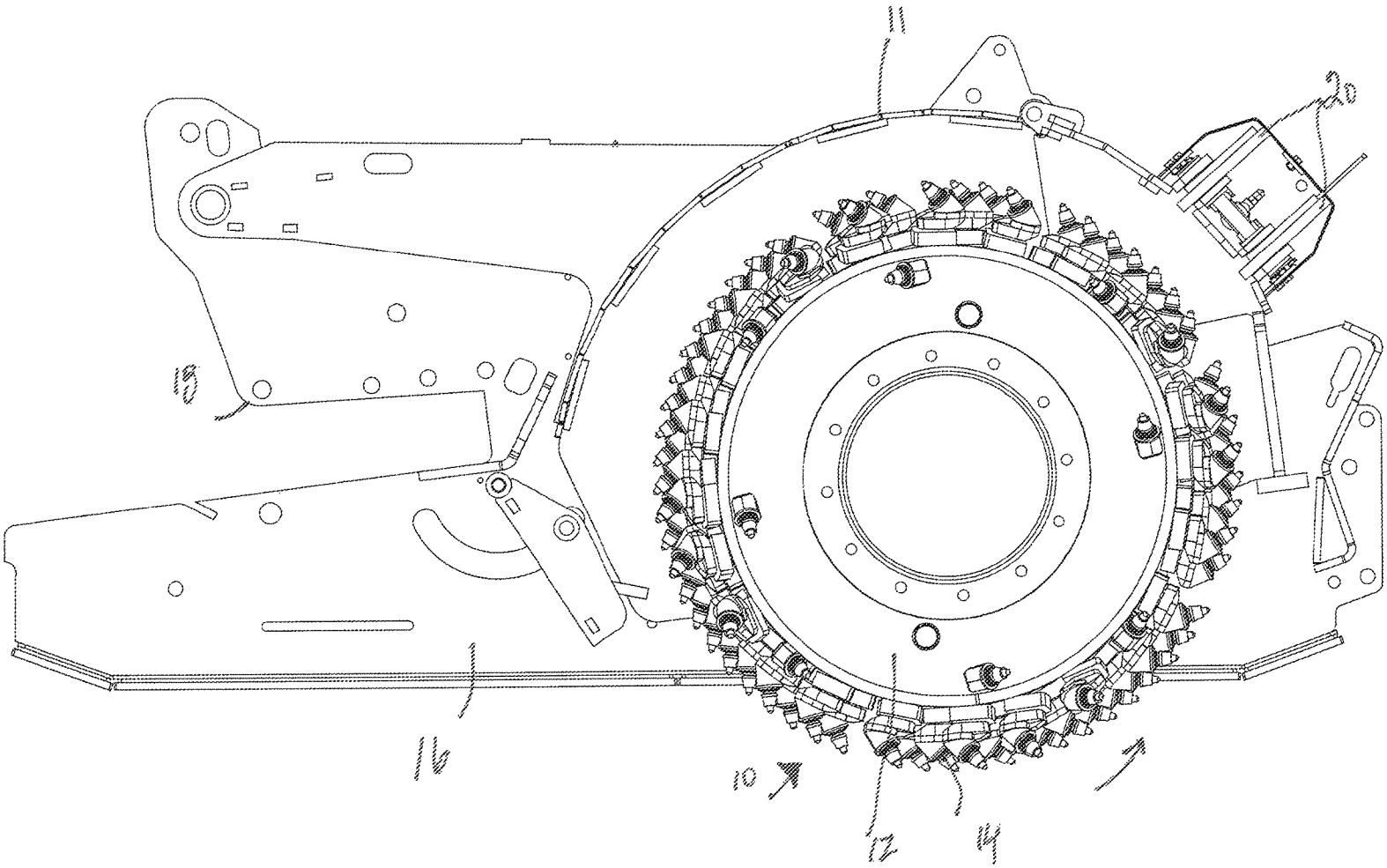
FIGS. 1 and 2 illustrate an elevational view of a milling attachment with the breaker bar retracted in FIG. 1 and extended in FIG. 2.

As provided above, embodiments of the present invention take place in association with a self-powered milling system that may be used to mill or grind paving material, and that may be configured to be coupled to a vehicle (e.g., a front-end loader, steer-skid, back hoe, excavator or other vehicle), which selectively pushes or pulls the self-powered milling system in a desired direction. With reference to FIG. 1, a representative embodiment of a self-powered milling system is illustrated as milling system 10, which includes a housing 11, a cutting head 12 having bits 14 attached thereon, and a carriage 16.

In FIG. 1, milling system 10 is configured to be coupled to a vehicle using vehicle coupler 18. In the illustrated embodiment, vehicle coupler 18 is adjustable to allow for a coupling of milling system 10 to any type of vehicle. Once coupled to milling system 10, the vehicle (not shown) may be operated by a user to selectively push or pull milling system 10 in a particular direction.

Milling system 10 comprises a motor which is separate from the motor of the vehicle. As such, milling system 10 is self-powered to enable the grinding or milling of paving material. More specifically, the motor (not shown) is dedicated to the actuating of cutting head 12 in order to grind or mill paving material under milling system 10. Cutting head 12 rotates so that bits 14 cut upward or as shown in FIG. 1 in a counter-clockwise direction. After the material is ground by bits 14, it passes over cutting head 12 and is redeposited into the original trench behind cutting head 12. Retractable breaker bars 20 are shown in their retracted position. Material passes unimpeded past breaker bars 20 in this position.

Figure 2:
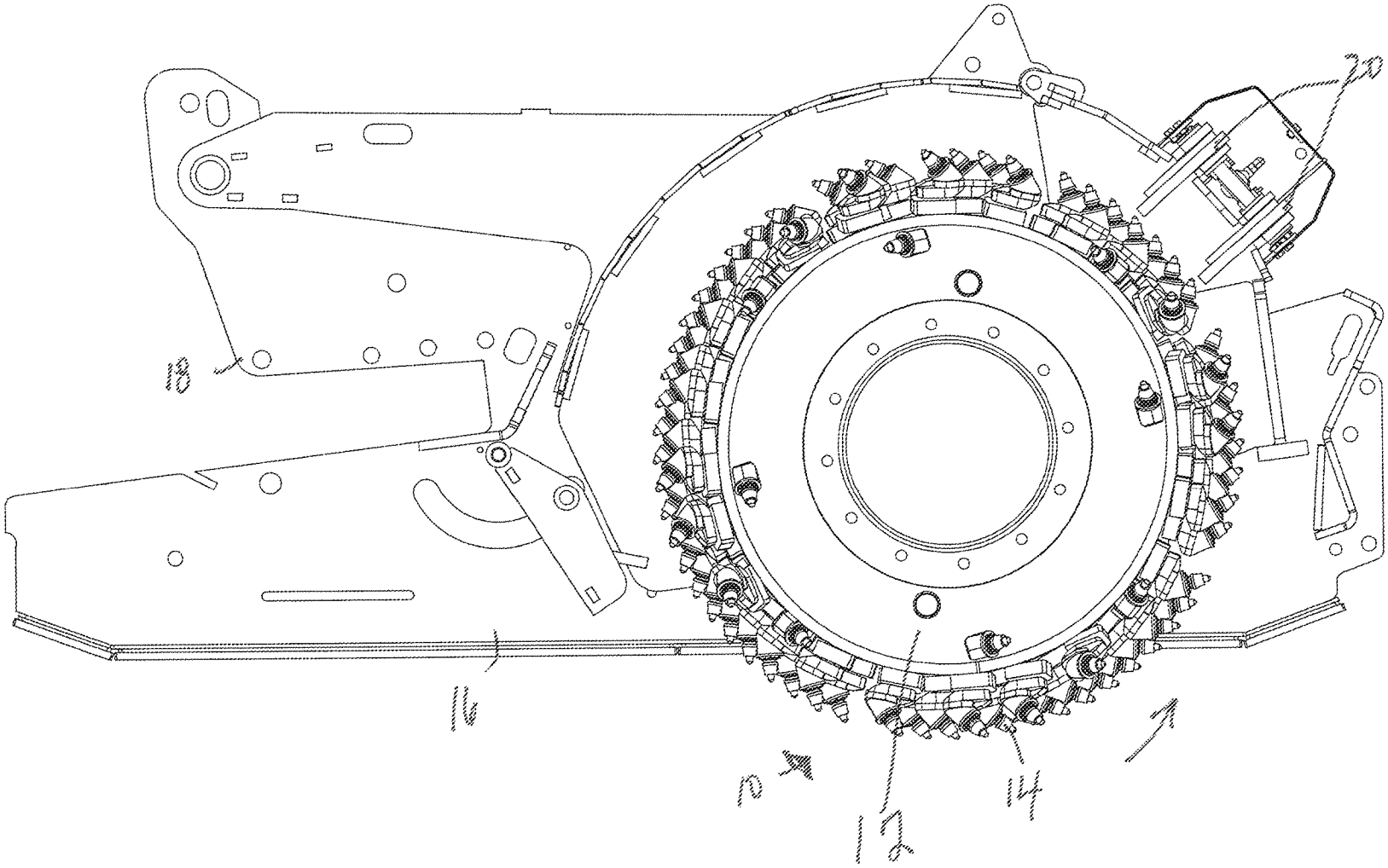

The use of cutting head 12 and more particularly, retractable breaker bars 20, is more fully illustrated in FIG. 2. As cutting head 12 is spinning, milling system 10 is pushed by a vehicle coupled thereto and mills paving material that passes underneath cutting head 12. The ground material passes upward until it reaches retractable breaker bars 20 shown in their extended position. Breaker bars 20 retain material and prevent material from passing over the top of cutting head 12. While retained, the material continues to be ground by bits 14 and becomes smaller in diameter. By varying the depth of extension of breaker bars 20, the size of the material redeposited into the trench behind cutting head 12 may be controlled. Extension of breaker bars 20 and the resultant build-up of material between the road surface and breaker bars 20, places a higher load on the engine rotating cutting head 12. An operator of the vehicle to which system 10 is coupled may need to slow the progress of system 10 to compensate for the higher load on the engine driving cutting head 12. In some instances, a worker walking alongside system 10 may be needed to communicate with the operator of the vehicle propelling system 10 to achieve the best balance of speed versus particle size output from system 10 and redeposited behind cutting head 12.

Figure 3:
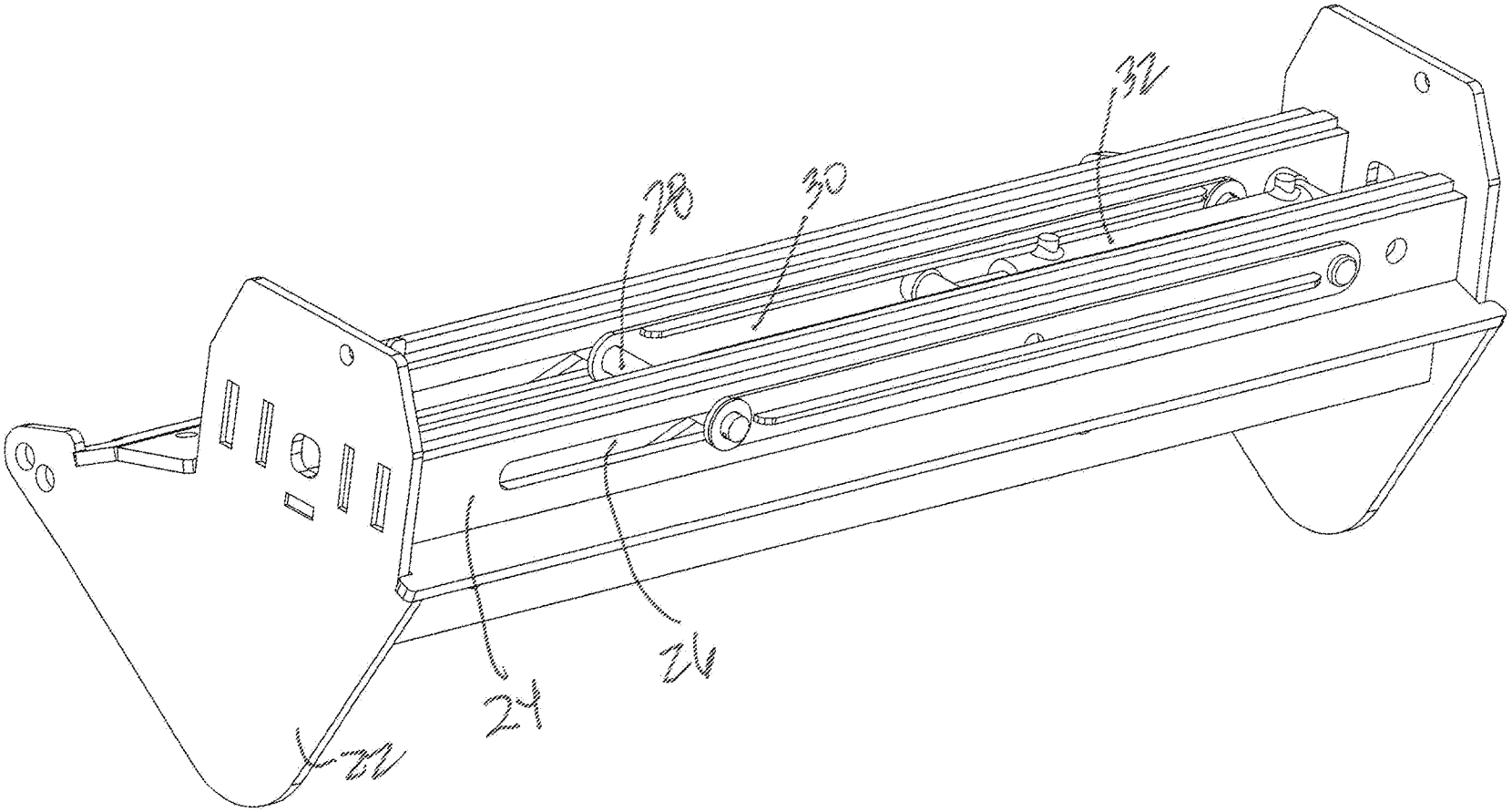
FIG. 3 illustrates a perspective view of a breaker bar frame with the breaker bar in a retracted position.

With reference now to FIG. 3, a frame 22 is shown having two ends connected by bars 24. Bars 24 have elongate slots through which pins 28 extend and travel within. Pins 28 are affixed to plates 30. Also attached to plates 30 is a hydraulic ram 32. When actuated, hydraulic ram 32 pushes plate 30. Movement of plate 30 is constrained by pin 28 to travel only within slot 26.

Figure 4:
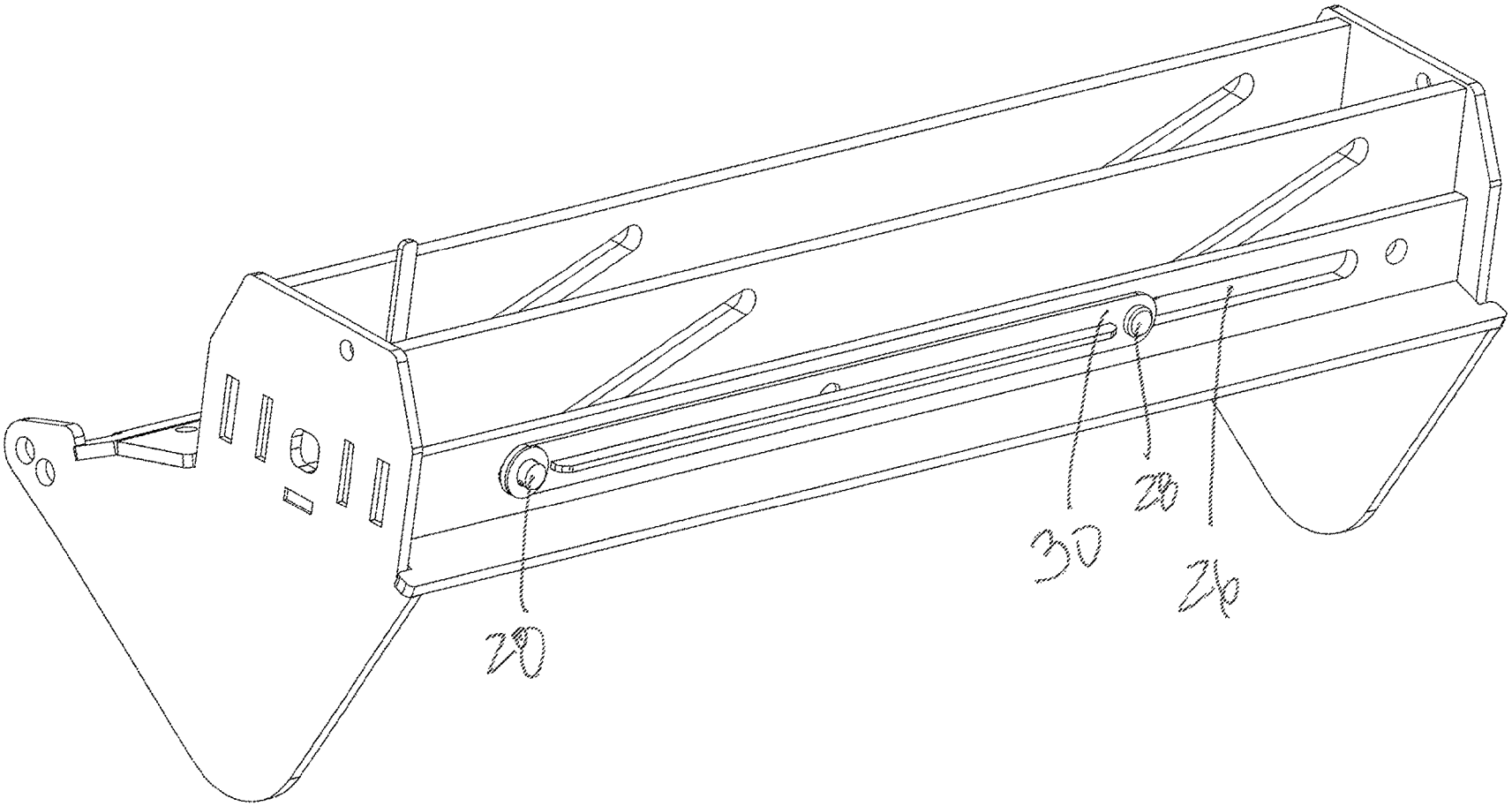
FIG. 4 illustrates an elevational view of the breaker frame showing an hydraulic ram activating the extension mechanism.

Turning now to FIG. 4, the travel of plate 30 within slot 26 is more clearly seen. The linear actuation by hydraulic ram 32 causes plate 30 to travel in slot 26.

Figure 5:
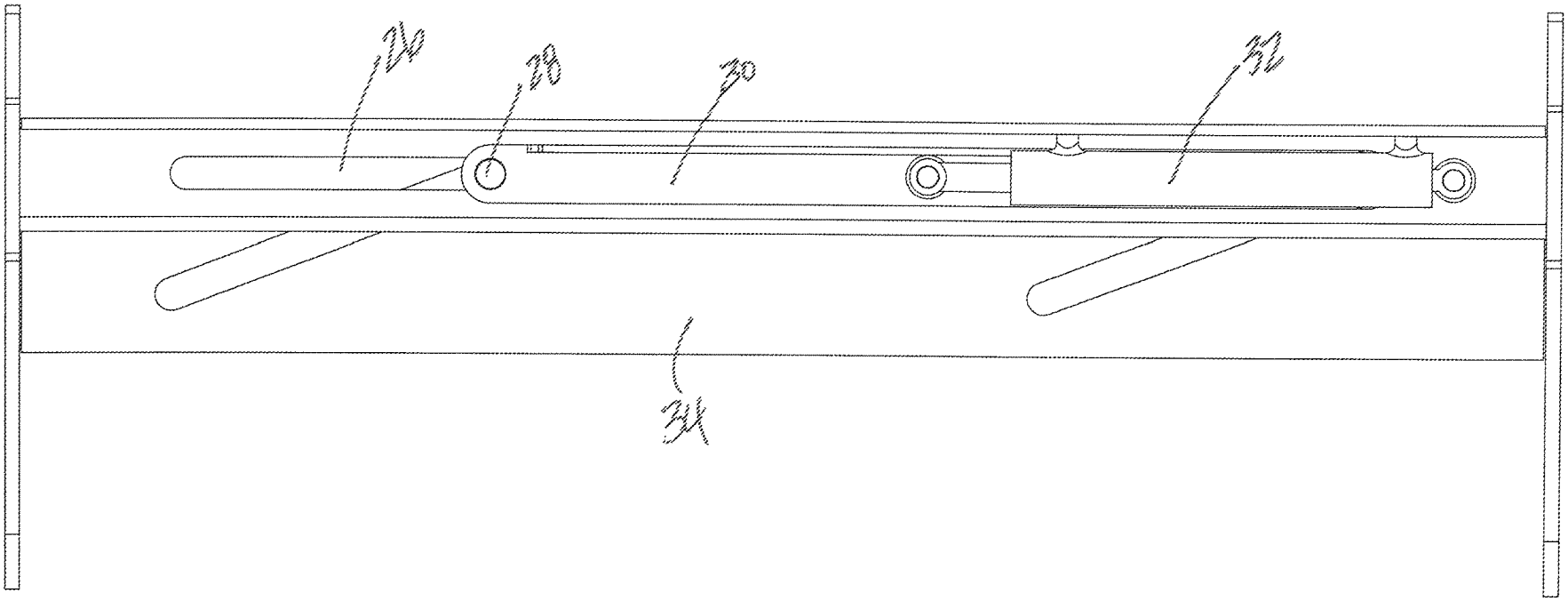
FIG. 5 illustrates the frame of FIG. 4 with the breaker bar in a retracted position.

FIG. 5 illustrates that a breaker bar 34 has diagonal slots 36 formed with in through which also passes pins 28. Thus, as hydraulic ram 32 pulls plate 30 toward hydraulic ram 32 in slot 26, pins 28 also move within diagonal slots 36. Because slot 36 are diagonal, movement of pin 28 is translated into movement of breaker bar 34 toward cutting head 12.

Figure 6:
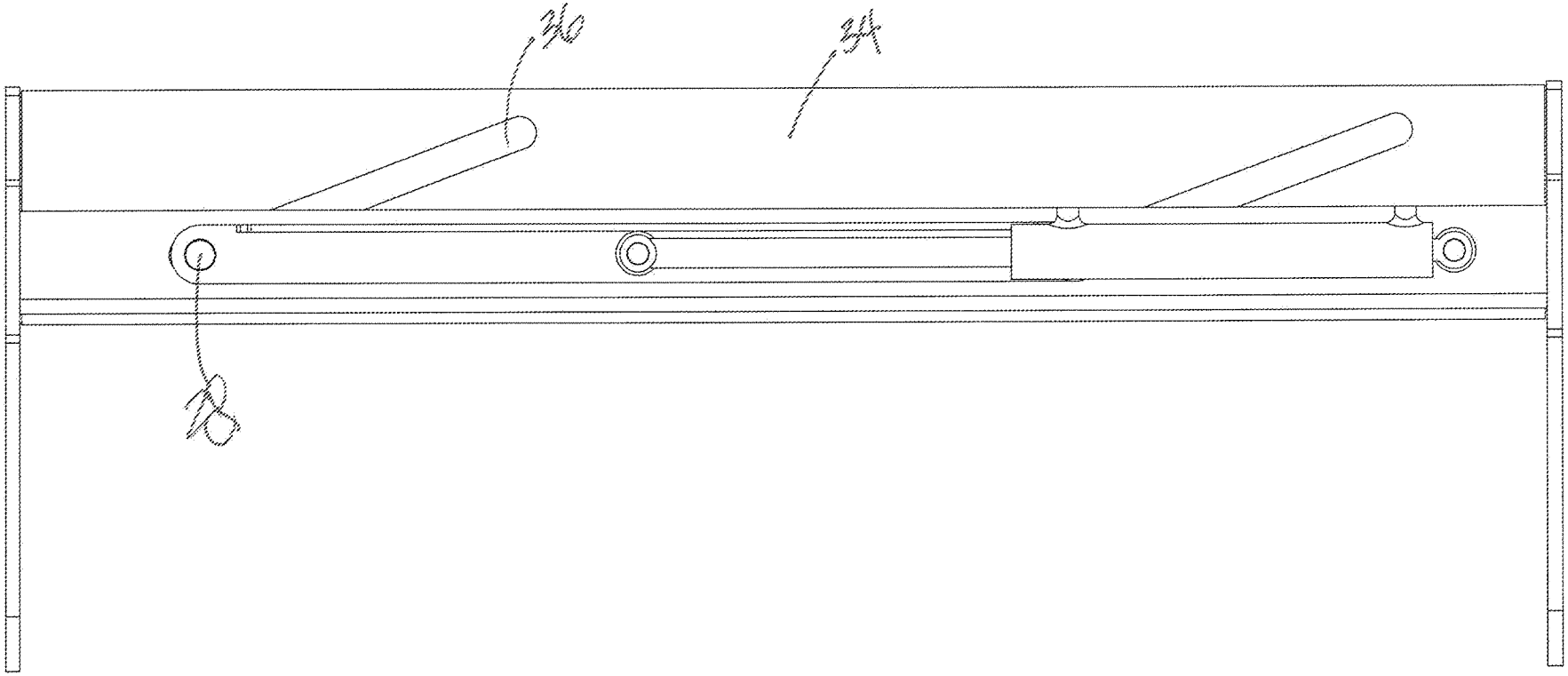
FIG. 6 illustrates the breaker bar in an extended position.

FIG. 6 illustrates breaker bar 34 in the retracted position. Hydraulic ram 32 is fully extended and pins 28 have forced breaker bar 34 to be lifted by the movement of pin 28 traveling in diagonal slot 36. In this retracted position, breaker bar 34 does not impede the flow of ground material around cutting head 12.

The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A cutting system for grinding material using a retractable breaker bar comprising:

a cutting head powered by an engine independent from a propulsion engine and having bits attached thereto;

a housing surrounding the cutting head to contain ground material;

a vehicle coupler for coupling of the cutting system to a propulsion vehicle;

a frame on the housing containing a hydraulic ram attached to pins which pass through slots in a plate; and a breaker bar having diagonal slots formed therein through which pass the pins so that retraction and extension of the hydraulic ram alters the distance of the breaker bar from the cutting head.

* * * * *